US005661980A

United States Patent [19]

Gallivan

[11] Patent Number: 5,661,980

[45] Date of Patent: Sep. 2, 1997

[54] THERMALLY STABILIZED DEWAR ASSEMBLY, AND ITS PREPARATION

[75] Inventor: James R. Gallivan, Pomona, Calif.

[73] Assignee: Hughes Missile Systems Company, Los Angeles, Calif.

[21] Appl. No.: 466,552

[22] Filed: Jun. 6, 1995

[51] Int. Cl.[6] ..... F25B 19/00

[52] U.S. Cl. ..... 62/51.1; 62/64

[58] Field of Search ..... 61/51.1, 64

[56] References Cited

U.S. PATENT DOCUMENTS

| | | | |
|---|---|---|---|
| 2,816,232 | 12/1957 | Burstein | 62/51.1 X |
| 3,066,222 | 11/1962 | Poorman et al. | 62/51.1 X |
| 3,180,989 | 4/1965 | Hand, Jr. et al. | 62/51.1 X |
| 3,398,549 | 8/1968 | Zobel | 62/51.1 X |
| 3,836,779 | 9/1974 | Bruno et al. | 62/51.1 X |
| 4,805,420 | 2/1989 | Porter et al. | 62/51.1 |
| 5,270,291 | 12/1993 | Sun et al. | 62/51.1 X |
| 5,471,844 | 12/1995 | Levi | 62/51.1 |

*Primary Examiner*—Christopher Kilner

*Attorney, Agent, or Firm*—Charles D. Brown; Wanda K. Denson-Low

[57] ABSTRACT

A dewar assembly has a wall contacting a liquefied gas within the interior of the dewar assembly. The dewar assembly is processed so as to remove the stable gaseous film boiling layer that is normally present between the liquefied gas and the wall. The processing is preferably accomplished by reducing the pressure on the liquefied gas to reduce its temperature and the temperature of the wall, and then returning the pressure over the liquefied gas to ambient to produce a temperature in the liquefied gas which is temporarily greater than that of the wall. The existing gaseous film boiling layer is removed, so that thermal and acoustic variations present in the system due to the presence of the film boiling layer are eliminated, and the liquefied gas attains a more direct contact with the wall.

23 Claims, 4 Drawing Sheets

THERMALLY STABILIZED DEWAR ASSEMBLY, AND ITS PREPARATION

BACKGROUND OF THE INVENTION

This invention relates to cryogenic apparatus, and, more particularly, to a dewar assembly processed to remove and avoid re-creation of a stable gaseous film boiling layer that otherwise lies between a wall within the dewar and the liquefied gas within the dewar.

A dewar includes an insulated vessel that contains a liquefied gas within its interior. Many electronic devices or other structures require either low temperatures for operation, or have improved performance when cooled. An example of such a device is an infrared detector, which is normally cooled to about liquid nitrogen temperature during service. The dewar maintains that low temperature environment for the device, which is in thermal communication with the liquefied gas in the dewar assembly during its operation.

The dewar assembly may be constructed with the structure to be cooled in place and the liquefied gas later added, or it may be first filled with the liquefied gas and the structure to be cooled added thereafter. In either case, cryogenically cold liquefied gas is contacted to an ambient-temperature wall within the dewar assembly at some point. As the cold liquefied gas contacts the warmer wall, some of the liquefied gas evaporates and forms a boundary layer of gas between the mass of liquefied gas and the wall. If, as is often the case, the wall of the structure remains warmer than the adjacent liquefied gas due to the insulating effect of the reduced thermal flux through the layer of gas, the local boiling continues and becomes a permanent feature of the interfacial region between the liquefied gas and the wall, as long as the liquefied gas is present and there is a heat flux through the cooled structure. The boiling boundary layer becomes a permanent gaseous film boiling layer.

The stable film boiling layer is undesirable in most cases because it acts as an insulator against rapid cooling of the structure. It is more troublesome in dewar systems which contain an electronic device that is to be cooled. The film boiling effect produces thermal and acoustic noise as the bubbles are nucleated, which noise can be detected by the electronic device and results in a decreased signal-to-noise ratio. The noise is particularly of concern during transient operation such as at the startup of the dewar assembly just after the liquefied gas is added.

There is a need for an approach to negate the effect of the permanent film boiling layer. The present invention fulfills this need, and further provides related advantages.

SUMMARY OF THE INVENTION

The present invention provides a method for permanently removing a stable gaseous film boiling layer that has previously formed in a dewar assembly. The removal is readily accomplished with a relatively minor modification to the structure of the dewar assembly and a change to the procedure of filling the dewar assembly with liquefied gas. No special treatment of the wall that is to be cooled or modification of the liquefied gas is required. The invention can be practiced at any time after the liquefied gas and the wall to be cooled have been brought into contact.

In accordance with the invention, a method for stabilizing a dewar assembly against film boiling comprises the steps of providing a dewar assembly having a wall in contact with an interior of the dewar and having a liquefied gas in the interior of the dewar. The wall has an initial temperature greater than the initial temperature of the liquefied gas within the interior of the dewar adjacent to the wall, due to the presence of a gaseous film boiling layer between the wall and the liquefied gas. The method further includes reducing the temperature of the wall to less than a final temperature of the liquefied gas adjacent to the wall, by altering the relative temperature of the wall with respect to the temperature of the liquefied gas adjacent to the wall such that the temperature of the liquefied gas adjacent to the wall is at the final temperature greater than the temperature of the wall for a period of time. During this period of time the gaseous film boiling layer is destabilized and removed. The wall and the liquefied gas adjacent to the wall are thereafter permitted to come to thermal equilibrium.

In a preferred approach, the temperature of the liquefied gas relative to the temperature of the wall can be varied by reducing the pressure over the liquefied gas and then rapidly increasing the pressure back to ambient pressure. Stated more generally, a method for stabilizing a dewar assembly against film boiling comprises the steps of providing a dewar assembly having an inner wall defining an interior of the dewar and an electronic device in thermal communication with the inner wall of the dewar. The dewar further has a liquefied gas in the interior of the dewar at ambient pressure, resulting in a gaseous film boiling layer between the inner wall and the liquefied gas. The gaseous film boiling layer is removed by first reducing the pressure over the liquefied gas within the interior of the dewar so that the temperature of the liquefied gas is less than the temperature of the inner wall of the dewar, maintaining the reduced pressure for a time sufficient for the temperature of inner wall of the dewar to fall below an ambient-pressure temperature experienced when the liquefied gas is at ambient pressure, and thereafter increasing the pressure over the liquefied gas within the interior of the dewar at a rate of increase and to a pressure such that the temperature of the liquefied gas is greater than the temperature of the inner wall of the dewar for a period of time.

In practice, these steps are readily performed using a conventional mechanical vacuum pump and a letdown valve. The first step of reducing the pressure above the liquefied gas is not itself sufficient to remove the gaseous film boiling layer. The gaseous film boiling layer is removed only after the pressure is increased, preferably back to ambient pressure, so that the temperature of the liquefied gas is temporarily greater than that of the wall. It has been found that the gaseous film boiling layer is permanently removed by this approach in all conditions tested, and does not return until the dewar assembly is warmed to ambient temperature and then refilled with liquefied gas. In that event, the previously described approaches can be repeated to remove the newly formed gaseous film boiling layer.

The present technique provides a readily implemented method for removing the otherwise-stable gaseous film boiling layer. When the method is practiced, it is operable to remove the layer from any surfaces where it exists at that time. Thus, for example, the method may be used to remove the layer initially from the inner walls of the dewar, and then used again at a later time to remove the layer from the walls of an object, such as an instrumentation probe, that is subsequently inserted into the liquefied gas. Other features and advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

Figure 1:
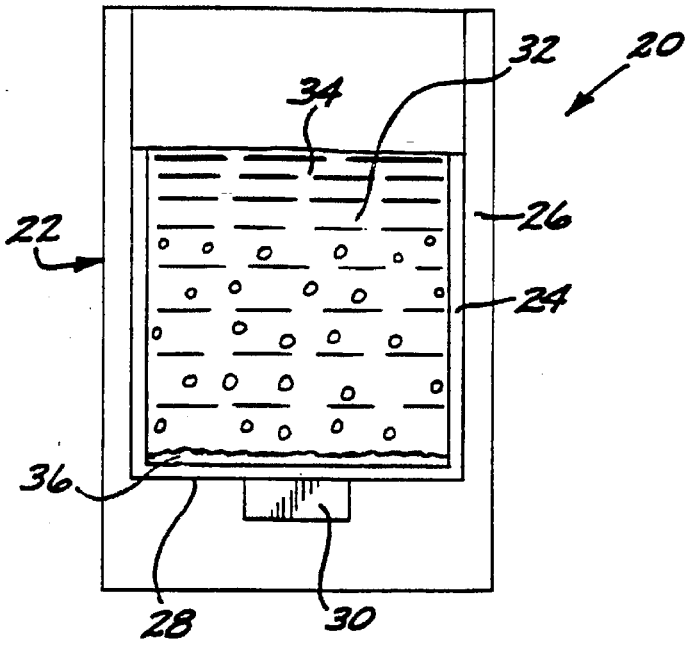
FIG. 1 is a schematic sectional drawing of a conventional cryogenic dewar assembly for use with an infrared detector.

FIG. 1 depicts the origin and effects of gaseous film boiling in a conventional dewar assembly 20. The dewar assembly 20 includes an insulated double-wall vessel 22 in the form of a housing having an inner wall 24 and an outer wall 26. A heat-conductive cold finger 28 forms a portion of the inner wall 24 at the lower end of the vessel 22. An electronic device 30 requiring cooling to cryogenic temperature during operation, in this case an infrared detector, is affixed to the cold finger 28. The inner wall 24 defines an interior 32 of the dewar assembly 20.

When the electronic device 30 is to be operated, a liquefied gas 34, here illustrated as liquefied nitrogen, is added to the interior 32 of the vessel 22. Before the liquefied gas 34 is added, the inner wall 24 is at ambient temperature. After the liquefied gas 34 is added, the inner wall 24 is initially cooled, but its temperature remains above that of the liquefied gas 34. Cooling is accomplished as heat conducted from the electronic device 30 by the cold finger 28 causes the liquefied gas 34 in contact with the cold finger 28 to boil. A gaseous film boiling layer 36 (whose width is exaggerated in FIG. 1 for clarity in illustration) forms as a boundary layer between the cold finger 28 portion of the inner wall 24 and that portion of the liquefied gas 34 which remains liquid at this point. The layer 36 acts as an undesirable insulator that reduces the heat flux from the cold finger 28 into the liquefied gas 34 and varies the thermal conductivity from the cold finger 28 to the liquefied gas 34 as a function of time, resulting in thermal and acoustic noise in the system.

Figure 2:
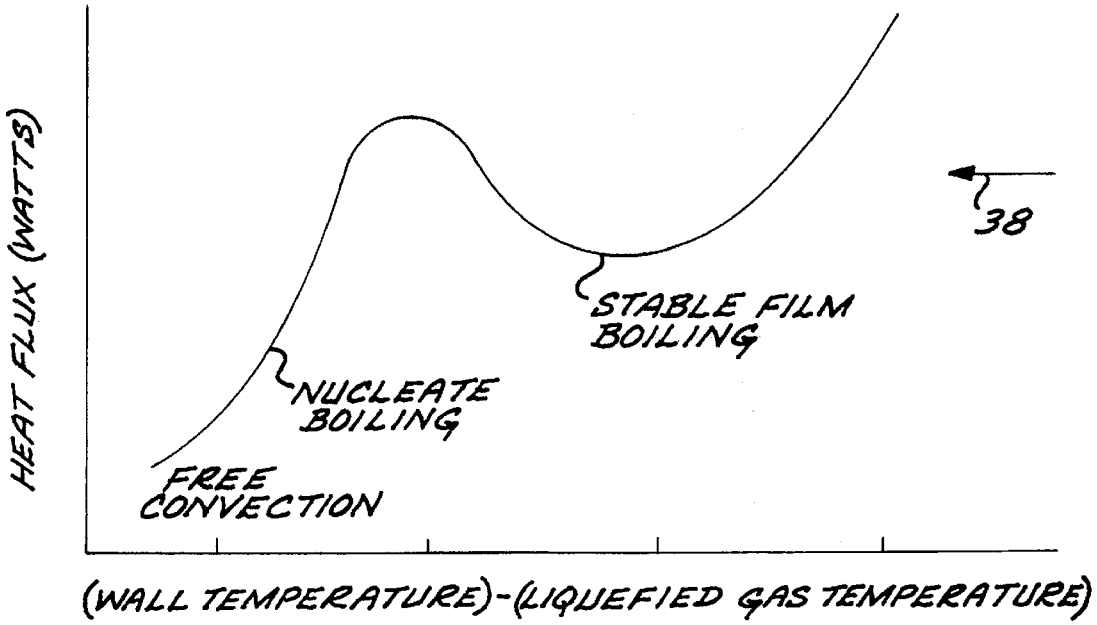
FIG. 2 is a schematic graph of the heat flow as a function of temperature difference in a dewar assembly.

FIG. 2 depicts schematically the heat flux between the cold finger 28 portion of the inner wall 24, as a function of the temperature difference between the wall and the liquefied gas. In the startup just described, as the liquefied gas is added the temperature difference is initially positive and very large. This state corresponds with a noisy, turbulent heat transfer. As the inner wall 24 cools, the heat flux is gradually reduced and, graphically, moves to the left along the curve in the direction indicated by arrow 38. The stable gas film boiling limits the heat flux that can be obtained.

Figure 3:
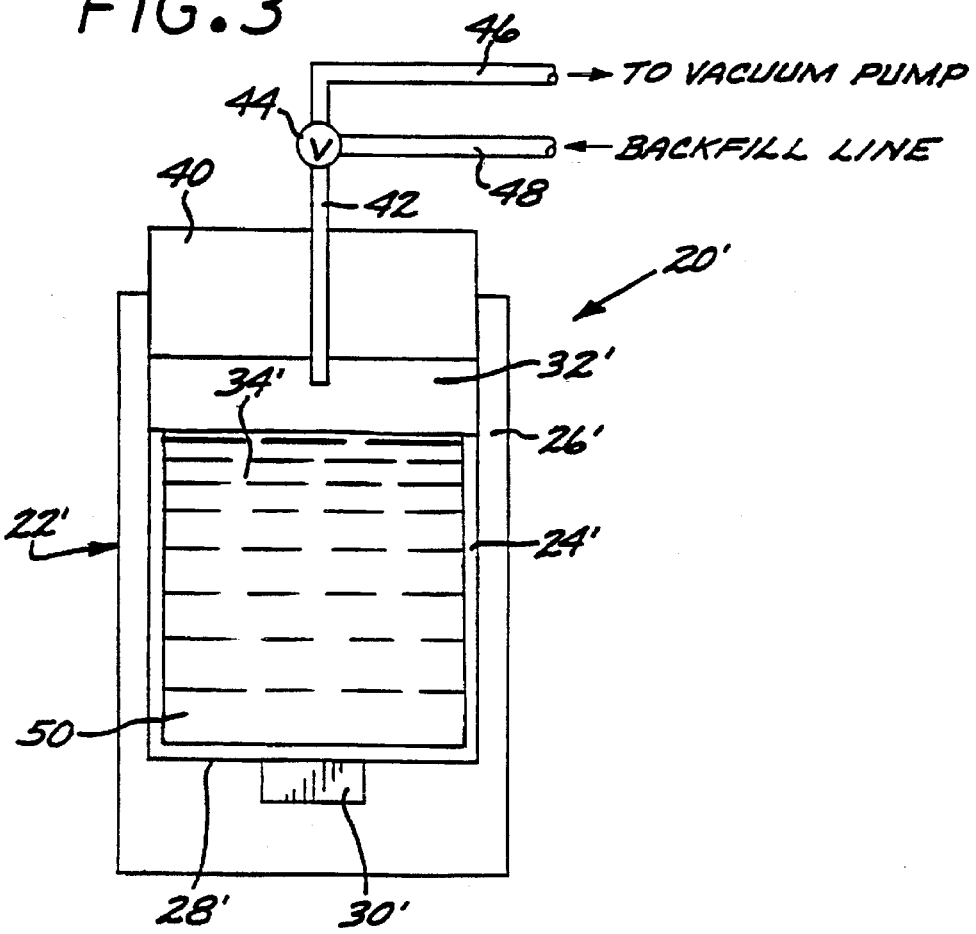
FIG. 3 is a schematic sectional view of a dewar assembly in accordance with the invention.

FIG. 3 illustrates a dewar assembly 20', whose structure includes a number of the same structural elements as the dewar assembly 20. In FIG. 3, the common structural elements have been assigned the same numbers as in FIG. 1, except with an appended prime sign ('), and the prior discussion of these elements is incorporated. Additionally, the apparatus 20' includes a closure 40 for the vessel 22, and a tube 42 penetrating the closure 40 to permit gaseous communication between the interior and the exterior of the vessel 22. A two-way valve 44 positioned on the exterior portion of the tube 42 allows the interior 32 of the vessel 22 to be controllably communicated with a vacuum through a vacuum line 46 or to atmosphere through a back-fill line 48.

Figure 5:
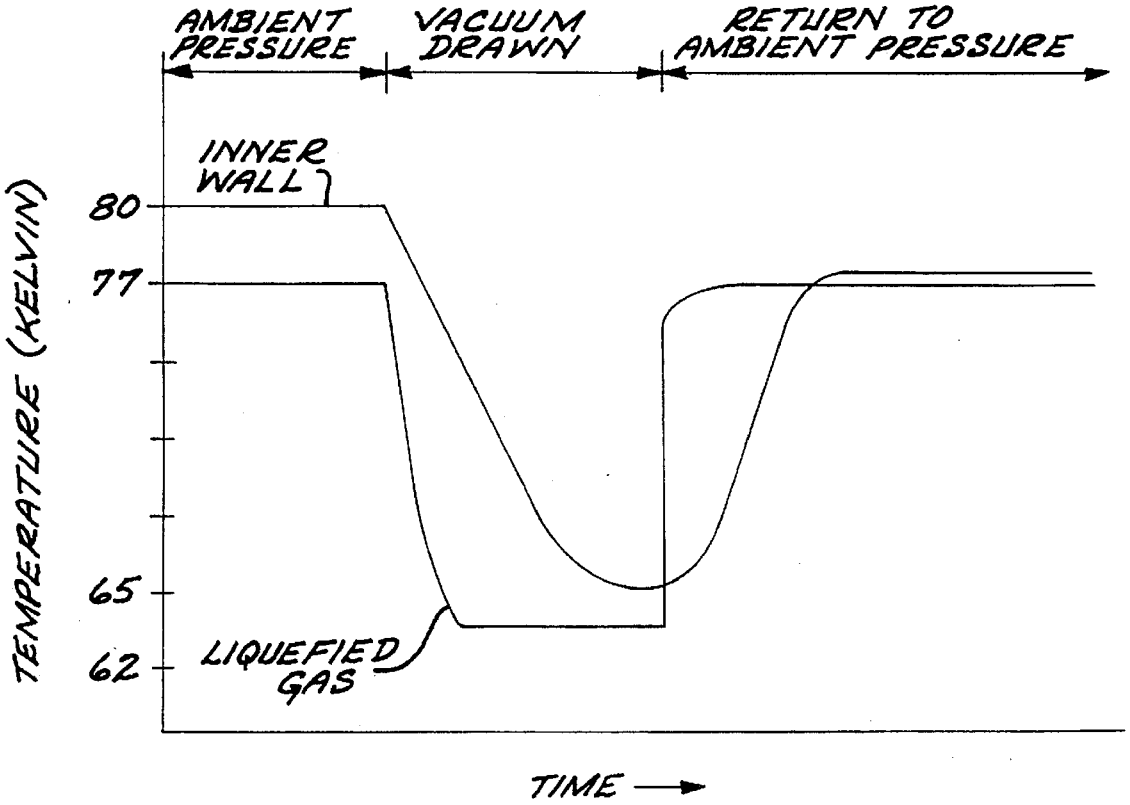
FIG. 5 is a schematic graph of temperature as a function of time as the method of the invention is practiced.
Figure 4:
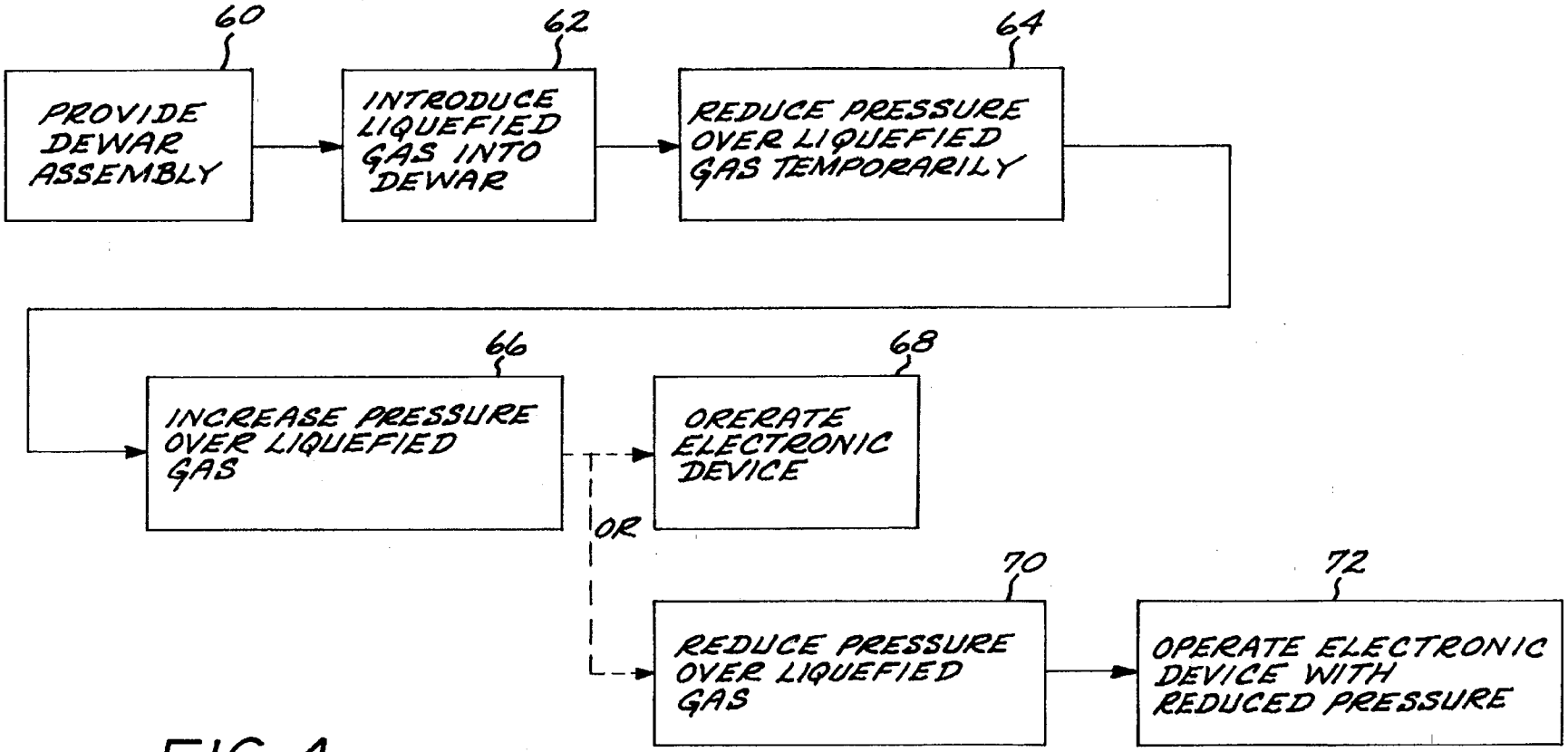
FIG. 4 is a block diagram for a preferred approach for practicing the method of the present invention.

FIG. 4 illustrates a preferred method for practicing the present invention, and FIG. 5 depicts an associated semi-schematic graph of temperature as a function of time. The dewar assembly 20' is provided, numeral 60. With the closure 40 removed, the liquefied gas 34' is introduced into the interior 32' of the dewar vessel 22', numeral 62. The "Ambient Pressure" portion of FIG. 5 shows the temperature of the inner wall 24', including the cold finger 28', to be about 80K and the temperature of the liquefied gas to be about 77K, after equilibrium is reached.

The closure 40 is thereafter inserted, and a vacuum is dram on the interior 32' of the vessel 22' above the liquefied gas 34' by connecting the vacuum line 46 to a vacuum pump or to a vacuum plunger and opening the valve 44, numeral 64. The vacuum need not be a high vacuum, and a vacuum of about 0.12 atmospheres has been found satisfactory. As seen in the "Vacuum Drawn" portion of FIG. 5, the application of the vacuum above the liquefied gas causes its temperature to fall within a short time to about 64K. The temperature of the inner wall 24' also falls, but less rapidly due to the insulating effect of the layer 36 which is present at this point and the thermal capacitance of the layer 36. The vacuum must be applied for a period of time sufficient that the temperature of the inner wall 24 falls below the equilibrium, final temperature of the liquefied gas, 77K in this case. That period of time varies depending upon the vacuum level and the configuration of the dewar, but is typically at least about 2 minutes for conventional small dewars evacuated to about 0.12 atmospheres. There is no harm to maintaining the vacuum for a longer period of time.

After the inner wall 24' has cooled to a temperature well below the ambient-pressure temperature of the liquefied gas, 77K in this case, the pressure over the liquefied gas is increased by operating the valve 44 to disconnect the vacuum source from the interior 32' of the vessel 22' and to backfill the interior to ambient pressure through the backfill line 48, numeral 66. The interior is returned to ambient pressure ("backfilled") relatively rapidly in a thermally nonequilibrium manner, which typically requires less than about 5 seconds, and most preferably less than about 1 second. (The backfill need not be to ambient pressure, but backfilling to ambient pressure is most convenient.) As seen in the "Return to Ambient Pressure" portion of FIG. 5, the temperature of the liquefied gas increases back to its ambient-pressure value relatively rapidly. The temperature of the inner wall 24' increases as a result of its thermal contact with the liquefied gas, but less rapidly than does the temperature of the liquefied gas. Thus, for a period of time after the pressure is increased, the temperature of the liquefied gas 34' is greater than that of the inner wall 24'. During this period of time, the gaseous film boiling layer is destabilized and disappears, leaving the dewar assembly without any gaseous film boiling layer, as indicated at numeral 50 in FIG. 3.

At this point after completion of step 66, the electronic device 30 is operated, numeral 68. Because of the absence of the gaseous film boiling layer and its associated thermal and acoustic noise, the operation of the electronic device 30 is more satisfactory than would be the case if the gaseous film boiling layer were present.

Liquid nitrogen bolls at ambient pressure at a temperature of 77K, as depicted in FIG. 5. The boiling temperature can be reduced by 13 degrees K or more by drawing a vacuum on the liquefied gas, also as illustrated in FIG. 5. In some situations, such as for certain types of detectors used in the electronic device 30, it is preferred to operate at such a reduced temperature by evacuating the dewar during operation of the electronic device 30. In that case, illustrated as an alternative path in FIG. 4, the pressure is again reduced after step 66 is complete, step 66 is complete, numeral 70, and the electronic device 30 is operated the reduced pressure is maintained, numeral 72.

The state and performance of the system during the operation 68 or 72 of the electronic device 30' reached by using the steps 64 and 66 is distinct from that reached by operating the electronic device 30' without using the steps 64 and 66 prior to operation. When steps 64 and 66 are first utilized, the gaseous film boiling layer is absent. When steps 64 and 66, or their equivalent, are not utilized, the gaseous film boiling layer is present. Thus, for example, if the dewar system were simply evacuated and the electronic device operated at the resulting reduced temperature, without the pressure increase of step 66, the noisy gaseous film boiling layer would remain. That is, if the electronic device is to be operated at a reduced temperature, step 72, two prior pressure reductions (steps 64 and 70) separated by a pressure increase (step 66) are required prior to the operation step 72.

In practice, the undesirable boiling state is preferably avoided during operation of the electronic device, and the system is placed into the non-boiling state and retained in this state. However, it may be necessary at times to intentionally disrupt the quiet non-boiling sate. For example, if a warm object, such as an intrumentation probe, is inserted into the liquefied gas, a gaseous film boiling layer is formed between the object and the liquefied gas. The result is unacceptable thermal and/or acoustic noise in the system which can adversely affect the measurements made by the electronic device. In this case, the gaseous film boiling layer is removed by performing the steps 64 and 66 of FIG. 4, bringing the system back to the quite, non-boiling state.

The present invention has been practiced using a dewar assembly with an infrared sensor as the electronic device, generally of the form depicted in FIG. 3. As described previously, the gaseous film boiling layer was initially formed but was removed by the process depicted in FIG. 4. Measurements showed a thermal noise reduction by a factor of 52 after the application of the present approach, as compared with the noise level prior to the processing.

Figure 6:
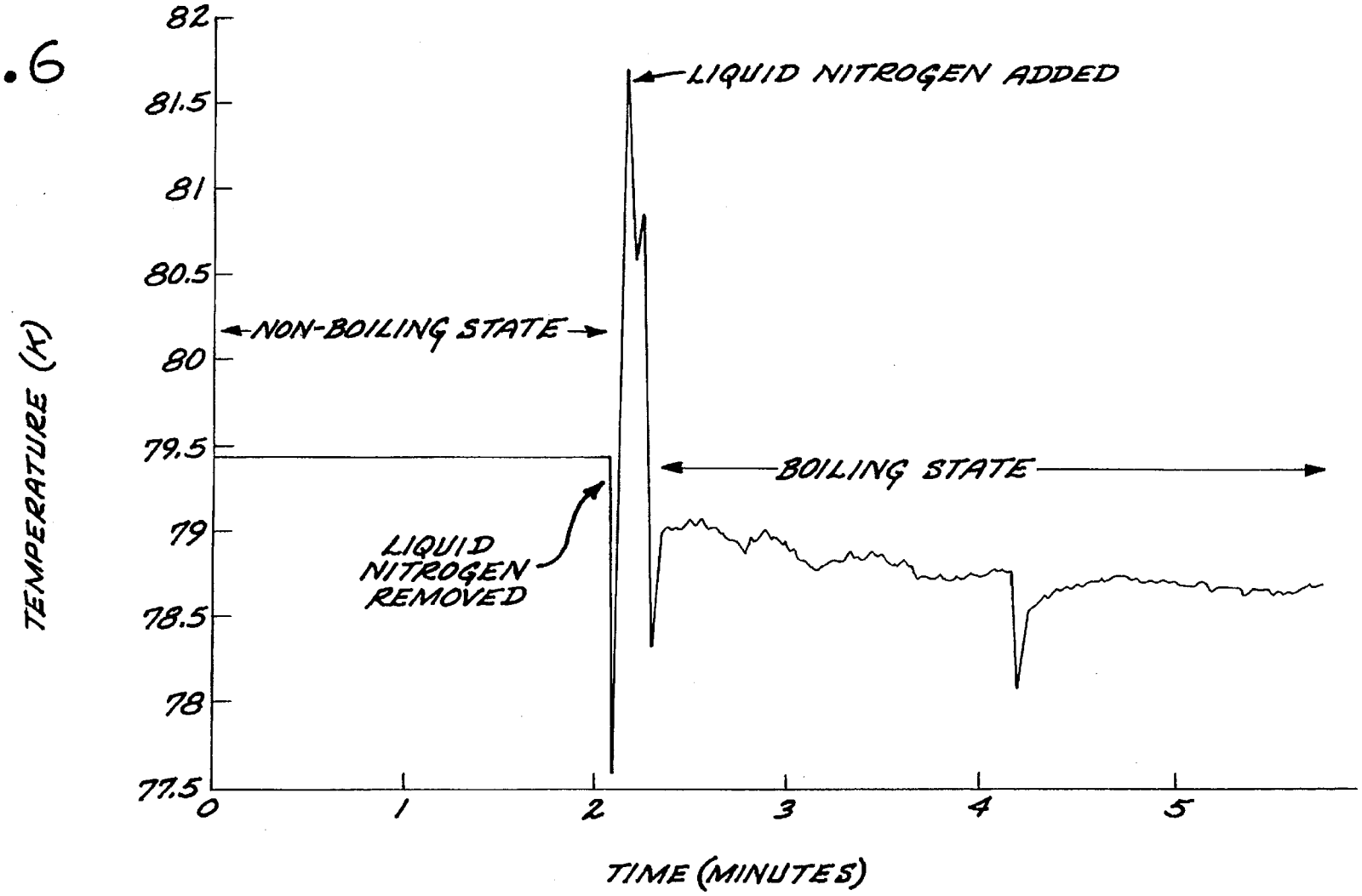
FIG. 6 is a graph of temperature variation in a dewar when the invention is practiced and when the invention is not practiced.

FIG. 6 depicts the result of a demonstration of the efficacy of the present approach. The procedure depicted in FIG. 4, steps 60, 62, 64, 66, and 68, was practiced, resulting in a non-boiling state for a period extending for about the first two minutes in the time scale of FIG. 4. (Other studies showed that this non-boiling state would continue indefinitely, but it was intentionally interrupted in order to perform the subsequently described comparative studies.) The thermal variation during this non-boiling period was small, resulting in a desirably low thermal noise for the operation of the electronic device 30. The liquid nitrogen was drained from the dewar, allowing the inner wall of the dewar to warm. New liquid nitrogen was added to the dewar, but due to the rewarming the gaseous film boiling layer returned. From a time of about 2½ minutes on the scale of FIG. 6 onward, there was a high thermal variation and thermal noise due to the reappearance of the boiling state. Other studies showed that the boiling state could be terminated at any time by following the procedure of steps 64 and 66 of FIG. 4, as described previously. Thus, the procedure of FIG. 4 allows the noisy boiling state to be terminated at will, and the non-boiling state initiated.

Using the same apparatus, the procedure of steps 60, 62, 64, 66, 70, and 72 was practiced. This procedure demonstrated that the electronic device could be operated at a reduced temperature, produced by the step 70, and with the absence of the boiling state and its associated thermal noise.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for stabilizing a dewar assembly against film boiling, comprising the steps of:

providing a dewar assembly comprising an inner wall defining an interior of the dewar assembly and an electronic device in thermal communication with the inner wall of the dewar assembly, the dewar assembly further having a liquefied gas within the interior of the dewar assembly;

reducing the pressure over the liquefied gas within the interior of the dewar assembly so that the temperature of the liquefied gas is less than the temperature of the inner wall of the dewar assembly, and maintaining the reduced pressure for a time sufficient for the temperature of inner wall of the dewar assembly to fall below an ambient-pressure temperature experienced when the liquefied gas is at ambient pressure; and increasing the pressure over the liquefied gas within the interior of the dewar assembly at a rate of increase and to a pressure such that the temperature of the liquefied gas is greater than the temperature of the inner wall of the dewar assembly for a period of time.

2. The method of claim 1, wherein the step of providing a dewar assembly includes the step of providing a dewar assembly having an infrared detector in thermal communication with the inner wall of the dewar assembly.

3. The method of claim 1, wherein the step of providing includes the step of introducing liquid nitrogen into the interior of the dewar assembly.

4. The method of claim 1, wherein the step of reducing the pressure includes the step of reducing the pressure to about 0.12 atmosphere for a time of at least about 2 minutes.

5. The method of claim 1, wherein the step of increasing the pressure includes the step of increasing the pressure to about 1 atmosphere.

6. The method of claim 1, wherein the step of increasing the pressure includes the step of increasing the pressure to about 1 atmosphere in a time of less than about 1 second.

7. The method of claim 1, including an additional step, after the step of increasing the pressure, of operating the electronic device.

8. The method of claim 1, including additional steps, after the step of increasing the pressure, of again reducing the pressure over the liquefied gas, and thereafter operating the electronic device while the pressure over the liquefied gas is reduced.

9. The method of claim 1, wherein the step of providing a dewar assembly includes the step of providing a dewar assembly comprising a housing including an outer wall and the inner wall.

10. The method of claim 1, wherein the step of reducing the pressure includes the step of reducing the pressure to less than 1 atmosphere, and wherein the step of increasing the pressure includes the step of increasing the pressure to 1 atmosphere.

11. A dewar assembly prepared according to the method of claim 2.

12. A method for stabilizing a dewar assembly against film boiling, comprising the steps of:

providing a dewar assembly comprising a wall in contact with an interior of the dewar assembly and a liquefied gas within the interior of the dewar assembly, the wall having an initial temperature greater than the initial temperature of the liquefied gas within the interior of the dewar assembly adjacent to the wall;

reducing the temperature of the wall to less than a final temperature of the liquefied gas adjacent to the wall;

altering the relative temperature of the wall with respect to the temperature of the liquefied gas adjacent to the wall such that the temperature of the liquefied gas adjacent to the wall is at the final temperature greater than the temperature of the wall for a period of time; and thereafter permitting the wall and the liquefied gas adjacent to the wall to come to thermal equilibrium.

13. The method of claim 12, wherein the step of providing includes step of providing a dewar assembly comprising a wall of the dewar assembly.

14. The method of claim 12, wherein the step of providing includes the step of providing a dewar assembly comprising a wall of a structure contacting the liquefied gas within the interior of the dewar assembly.

15. The method of claim 12, wherein the step of reducing includes the step of applying a vacuum to the liquefied gas.

16. The method of claim 15, wherein the step of altering includes the step of increasing the pressure over the liquefied gas.

17. The method of claim 15, wherein the step of altering includes the step of returning the pressure over the liquefied gas to ambient pressure.

18. The method of claim 12, including an additional step, after the step of increasing, of operating an electronic device within the dewar assembly.

19. The method of claim 12, including additional steps, after the step of increasing, of again reducing the pressure over the liquefied gas, and thereafter operating the electronic device while the pressure over the liquefied gas is reduced.

20. The method of claim 12, wherein the step of providing a dewar assembly includes the step of providing a dewar assembly comprising a housing including an outer wall and the wall in contact with the interior of the assembly.

21. A dewar assembly prepared according to the method of claim 20.

22. A dewar assembly, comprising:

a dewar housing having an interior;

a wall in contact with the interior of the dewar housing;

a liquefied gas in contact with the wall, there being no stable gaseous film boiling layer in the liquefied gas adjacent to the wall.

23. The dewar assembly of claim 22, wherein the dewar assembly further includes means for reducing a pressure over the liquefied gas.

* * * * *